United States Patent [19]

Sandelman

[11] 4,114,298

[45] Sep. 19, 1978

[54] PERPETUAL CALENDAR

[76] Inventor: Robert L. Sandelman, 2112 E. Hillhaven Dr., Brea, Calif. 92621

[21] Appl. No.: 792,855

[22] Filed: May 2, 1977

[51] Int. Cl.[2] ..... G09D 3/00

[52] U.S. Cl. ..... 40/110; 40/107

[58] Field of Search ..... 40/110, 109, 107, 125 A, 40/28 C, 152.1, 128; 283/2-4

[56] References Cited

U.S. PATENT DOCUMENTS

| | | | |
|---|---|---|---|
| 1,363,427 | 12/1920 | Melton | 40/107 |
| 3,827,168 | 8/1974 | Mori | 40/110 |
| 4,015,351 | 4/1977 | Sasson | 40/110 |
| 4,028,826 | 6/1977 | Brandifino et al. | 40/110 |

*Primary Examiner*—John F. Pitrelli
*Attorney, Agent, or Firm*—Gerald L. Price

[57] ABSTRACT

A perpetual calendar which has transparent letters and numbers positioned in a predetermined matrix arrangement on an opaque sheet. Within the predetermined matrix arrangement of numbers and letters are abbreviations for the name of each day of the week, each month of the year, and the numerals one through thirty-one. Small pieces of opaque material which will adhere to the sheet are sized to overlie any abbreviation of the name of the days of the week, any abbreviation for the months of the year, and any numerals between one and thirty-one within the matrix so that any calendar date can be readily indicated on the calendar by adhering the pieces of opaque material to the rear of the transparent letters and numerals within the matrix defining the particular month and name of day abbreviations and the day of the month.

9 Claims, 3 Drawing Figures

PERPETUAL CALENDAR

BACKGROUND OF THE INVENTION

The present invention relates generally to calendars and more particulary to an improved perpetual calendar which enables any desired date to be readily indicated.

There are a large number of various types of perpetual calendars available or known in the prior art which essentially consist of some form of changeable mechanism which enables any day and month to be indicated. Such mechanisms include number and name indicia applied to revolving cylinders and discs wherein the desired portion of indicia will appear in a window or the like. While perpetual calendar devices of these types provide certain benefits, they are in general relatively costly to manufacture and many of these devices take considerable time to reset to a new data and are often bulky and unesthetic in appearance.

SUMMARY OF THE INVENTION

Accordingly, it is the general aim of the present invention to provide a new and improved perpetual calendar apparatus which is more compact and portable and yet more efficient than perpetual calendars that have heretofore been available. A related object of this invention is to provide an improved perpetual calendar which provides a pleasing appearance and can be utilized as part of a home or office decor and which can be rapidly changed to indicate any desired calendar date.

It is another object of the invention to provide a relatively low cost perpetual calendar which is made of a minimum of parts thus simplifying the manufacturing and packaging of same.

While the present invention is concerned with the provision of a new and improved perpetual calendar, it is nevertheless, an object of the invention to provide an improved perpetual calendar which lends itself to being mounted on a wall yet capable of being readily removed and replaced for date setting purposes.

BRIEF DESCRIPTION OF THE DRAWINGS

Other objects and advantages of the present invention, along with the interrelationship between the elements of the preferred embodiment, will become more apparent when considered in connection with the specification and accompanying drawings in which.

Figure 1:
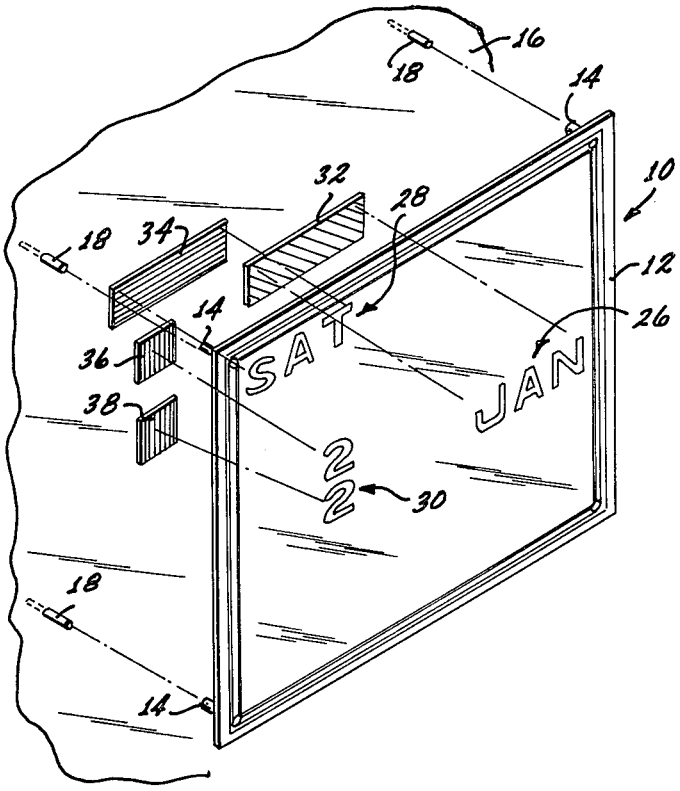
FIG. 1 is a perspective view of an exemplary perpetual calendar embodying the features of the present invention and illustrating how a particular calendar date is depicted.

While the present invention is susceptible of various modifications and alternative constructions and can be used with various types of materials and overall designs, illustrative embodiments are shown in the drawings and will hereinafter be described in detail. It should be understood, however, that it is not intended to limit the invention to the particular embodiment disclosed, but, on the contrary, the intention is to cover all equivalents and alternative constructions falling within the spirit and scope of the invention as expressed in the appended claims.

DESCRIPTION OF THE PREFERRED EMBODIMENT

Figure 2:
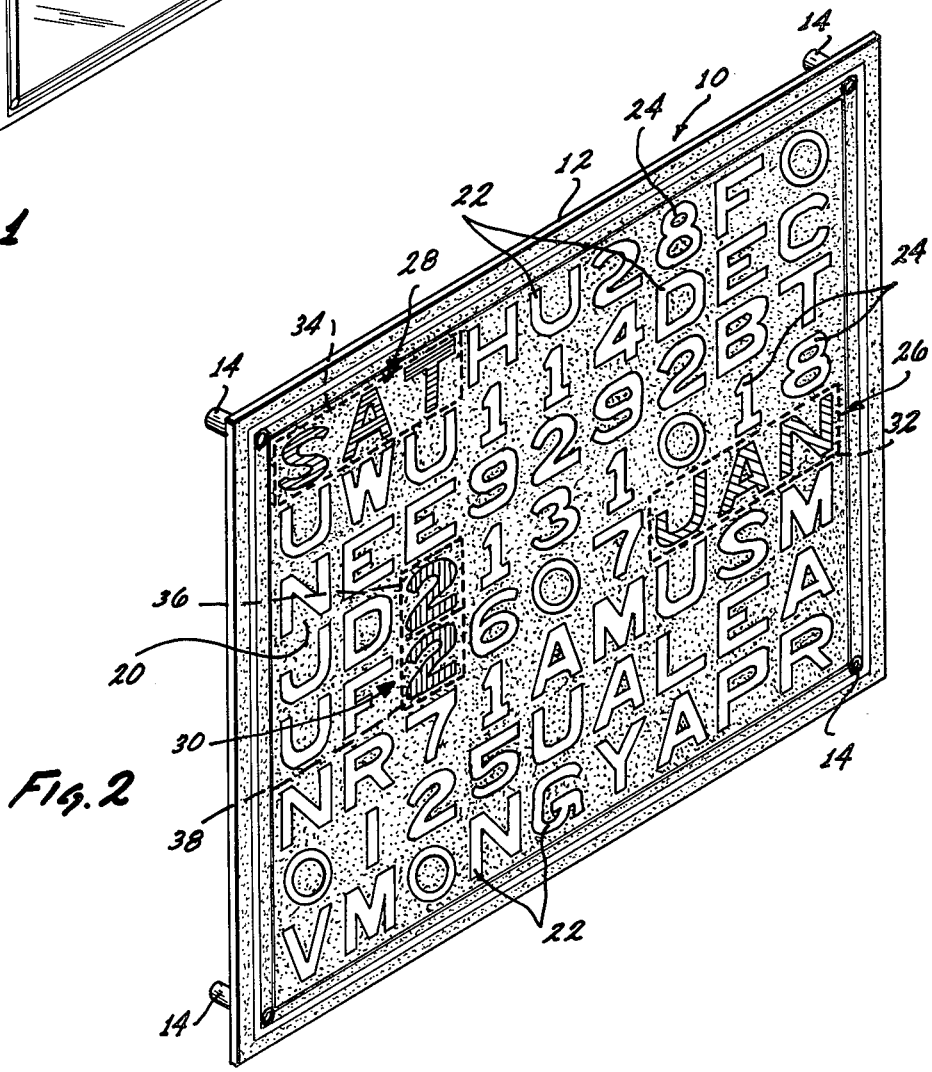
FIG. 2 is a perspective view of the front portion of the perpetual calendar shown in FIG. 1 with all indicia being shown together with a particular calendar date being depicted.

Referring now to FIGS. 1 and 2, an exemplary perpetual calendar generally indicated at 10, is illustrated, the unit including a generally rectangular sheet 12 which is originally transparent and then coated with an opaque material 20 in such a manner as to define a rectangular matrix of letters 22 and numerals 24 which as shown in FIG. 2 are arranged in a particular order and which are transparent as contrasted to the remaining opaque portion of the sheet 12.

In accordance with one of the important aspects of the present invention, a particular rectangular matrix arrangement of letters and numerals as illustrated in FIG. 2 has been developed and applied to sheet 12 so as to enable any calendar date to be readily depicted. Within the rectangular matrix of letters 22 and numerals 24 illustrated in FIG. 2 can be found three letter abbreviations for each month of the year, three letter abbreviations for each name of the days of the week, and numerals 1 through 31. Different name abbreviations and numerals may appear in the matrix in either a horizontal or vertical arrangement. For example, the calendar date Saturday, January 22nd is depicted in FIG. 1 and FIG. 2 by the abbreviation for January generally shown at 26 and the abbreviation for Saturday generally shown at 28 both appearing within the matrix horizontally and the numeral 22 shown generally at 30 appearing vertically within the matrix. In order to have a particular calendar date such as, for example, Saturday, January 22nd be indicated on the perpetual calendar of the present invention, pieces of opaque material 32 and 34 are provided which are each sized to overlie any three successive letters appearing in the matrix arrangement in either a horizontal or vertical direction and opaque pieces 36 and 38 which are sized to overlie a single numeral appearing in the matrix. All four pieces are adapted to be readily affixed to the rear surface of the sheet 12 as shown in detail in FIG. 3.

In practice, it has been found that fabricating pieces 32, 34, 36 and 38 out of thin flexible opaque vinyl sheet material provides satisfactory adherence to the rear of sheet 12 if it is a smooth surface such as plastic or glass due to static attraction which further enables pieces 32, 34, 36 and 38 to be readily removed and reused to indicate any particular date.

Figure 3:
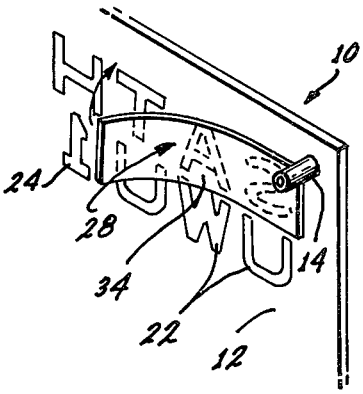
FIG. 3 is a fragmentary perspective view of the upper right hand portion of the perpetual calendar shown in FIG. 1 illustrating a particular day of the week being depicted.

As shown collectively in FIGS. 1, 2 and 3, by utilizing pieces 32, 34 and either 36 by itself or 36 and 38 together, any calendar date can be readily indicated on the perpetual calendar of the present invention by applying piece 32 to the rear of the three successive letters in the matrix defining the abbreviation for the desired month of the year, by applying piece 34 to the rear of the three successive letters in the matrix defining the abbreviation for the desired day of the week, and by applying piece 36 alone or in conjunction with and adjacent to piece 38 to the numeral or successive two numerals in the matrix defining the desired day of the month. When such pieces are applied as just described, the desired calendar date will appear by virtue of the opaque pieces being positioned directly behind the transparent letters as shown in FIG. 2. If desired, piece 32, 34 and 36 and 38 can be of three different colors as indicated in FIGS. 1 and 2.

In accordance with another important aspect of the present invention, provision is made for displaying the perpetual calendar 10 of the present invention by hanging it on the wall and yet being able to readily remove it and rehang it to facilitate the changing of dates. To accomplish this, a plurality of tubes 14 are affixed to the respective corners of sheet 12 as shown collectively in the three figures of the drawing and each tube 14 is adapted to slip over a respective nail 18 which is permanently affixed in the wall 16 on which it is desired to hang and display the calendar 10. As shown in FIG. 1, when four nails 18 are affixed to the wall 16 in the same spaced arrangement as the tubes 14, the entire calendar can be securely positioned on the wall 16 and yet be readily removable for date changing or cleaning purposes.

As shown in FIG. 2, the matrix of letters and numerals which has been developed for use with the present invention is of a compact rectangular configuration having eight rows and nine columns. It has also been found that if this matrix is rotated and reversed in a mirror image so that the letter s shown in FIG. 2 at the upper left hand corner of the matrix is positioned at the same location but with the matrix in a configuration of nine rows and eight columns, the perpetual calendar of the present invention will also function as heretofore described.

Having described my invention, I claim:

1. A perpetual calendar comprising:

a sheet of substantially opaque material having a predetermined matrix arrangement of transparent letters and numerals thereon for predetermined random horizontal and vertical display of abbreviations for each month of the year and the name of each day of the week defined within the matrix by successive groups of said letters and each numerical day of the month from one to thirty-one being defined within the matrix by a single numeral or two successive numerals;

a first piece of substantially opaque material of a color contrasting to said opaque sheet and having means whereby it can be affixed to said sheet, and sized to overlie a successive group of letters within the matrix on said sheet defining an abbreviation for a month of the year;

a second piece of substantially opaque material of a color contrasting to said opaque sheet and having means whereby it can be affixed to said sheet, and sized to overlie a successive group of letters within the matrix of said sheet defining an abbreviation for the name of a day of the week;

at least a third piece of substantially opaque material of a color contrastive to said opaque sheet and having means whereby it can be affixed to said sheet, and sized to overlie at least one numeral within the matrix on said sheet; and wherein at least a portion of the abbreviations for months of the year within the matrix share a letter in the matrix with another abbreviation for a month of the year, at least a portion of the abbreviations for the names of the days of the week share a letter in the matrix with another abbreviation for the name of a day of the week, and at least a portion of the numerals between 10 and 31 share one numeral in the matrix with another numeral between 10 and 31.

2. The calendar set forth in claim 1 wherein the matrix comprises eight horizontal rows and nine vertical columns.

3. The calendar set forth in claim 2 wherein the letters and numerals in the matrix are arranged in the following order:

| | | | | | | | | |
|---|---|---|---|---|---|---|---|---|
| S | A | T | H | U | 2 | 8 | F | O |
| U | W | U | 1 | 1 | 4 | D | E | C |
| N | E | E | 9 | 2 | 9 | 2 | B | T |
| J | D | 2 | 1 | 3 | 1 | 0 | 1 | 8 |
| U | F | 2 | 6 | 0 | 7 | J | A | N |
| N | R | 7 | 1 | A | M | U | S | M |
| 0 | 1 | 2 | 5 | U | A | L | E | A |
| V | M | O | N | G | Y | A | P | R |

4. The calendar set forth in claim 1 wherein the matrix comprises nine horizontal rows and eight vertical columns.

5. The calendar set forth in claim 4 wherein the letters and numerals in the matrix are arranged in the following order:

| | | | | | | | |
|---|---|---|---|---|---|---|---|
| S | U | N | J | U | N | O | V |
| A | W | E | D | F | R | I | M |
| T | U | E | 2 | 2 | 7 | 2 | 0 |
| H | 1 | 9 | 1 | 6 | 1 | 5 | N |
| U | 1 | 2 | 3 | 0 | A | U | G |
| 2 | 4 | 9 | 1 | 7 | M | A | Y |
| 8 | D | 2 | 0 | J | U | L | A |
| F | E | B | 1 | A | S | E | P |
| O | C | T | 8 | N | M | A | R |

6. The calendar as set forth in claim 1 wherein said first piece is of a color different than said second piece, said second piece is of a color different than said third piece, and said third and fourth pieces are of the same color.

7. The calendar as set forth in claim 1 wherein said sheet of substantially opaque material is substantially rigid.

8. The calendar as set forth in claim 7 wherein said sheet is further provided with means to permit it to be removeably hung on a wall by nails permanently affixed to said wall, said means comprising at least one tube affixed to said sheet and outwardly depending from the rear side thereof so as to be able to slip over a pre-existing nail affixed to such wall and depending horizontally outwardly therefrom.

9. The calendar as set forth in claim 1 wherein said first, second, third and fourth pieces of substantially opaque material are affixed to said sheet by static attraction and can be repeatedly removed and reaffixed thereto.

* * * * *